United States Patent [19]

Yasuhara

[11] 4,355,621

[45] Oct. 26, 1982

[54] INJECTION ADVANCE DEVICE

[75] Inventor: Seishi Yasuhara, Yokosuka, Japan

[73] Assignee: Nissan Motor Company, Limited, Yokohama, Japan

[21] Appl. No.: 145,155

[22] Filed: Apr. 30, 1980

[30] Foreign Application Priority Data

May 1, 1979 [JP] Japan ..... 54-53602
Sep. 3, 1979 [JP] Japan ..... 54-112590
Sep. 3, 1979 [JP] Japan ..... 54-112591

[51] Int. Cl.[3] ..... L02M 39/00; F02M 39/00; F02D 1/16

[52] U.S. Cl. ..... 123/502; 123/500; 123/501

[58] Field of Search ..... 123/502, 501, 500

[56] References Cited

U.S. PATENT DOCUMENTS 3,147,746 9/1964 Höfer ..... 123/502
4,214,564 7/1980 Skinner ..... 123/502

FOREIGN PATENT DOCUMENTS 2056719 3/1981 United Kingdom ..... 123/502
2057165 3/1981 United Kingdom ..... 123/502

*Primary Examiner*—Raymond A. Nelli
*Attorney, Agent, or Firm*—Thompson, Birch, Gauthier & Samuels

[57] ABSTRACT

A injection advance device is disclosed for diesel engine fuel injection pump including a pump housing, a feed pump for supplying fuel pressure proportional to engine speed into the pump chamber, and a control member movable to determine a fuel-injection timing corresponding to its position. The injection advance device comprises a casing, a cylinder reciprocally located in the casing, a piston reciprocally located in the cylinder and drivingly connected to the control member, and means for allowing movement of the piston in a direction causing the control member to advance the fuel-injection timing. Means is provided for moving the cylinder in a direction holding the piston in the position before the engine is warmed up.

13 Claims, 30 Drawing Figures

INJECTION ADVANCE DEVICE

BACKGROUND OF THE INVENTION

1. Field of the Invention

This invention relates to a fuel injection pump for use in a diesel engine and, more particularly, to an automatic injection advance device for use therewith.

2. Description of the Prior Art

It is common practice in diesel engines to vary fuel injection timing in accordance with the frequency of rotation of the engine. For this purpose, diesel engines have a fuel injection pump with an injection advance device for injecting fuel with an advance determined by engine speed. In view of higher engine starting stability, such injection advance is important particularly when the engine is starting.

FIG. 1 is a longitudinal sectional view of a conventional fuel injection pump with the injection advance device being shown as rotated clockwisely 90 degrees from its actual position for convenience of illustration, and FIG. 2 is a transverse sectional view showing the relative relationship between the injection advance device and roller ring.

Referring to FIG. 1, the fuel injection pump comprises a pump housing 10 containing therein a feed pump 11 driven by a drive shaft 12 drivingly connected with the engine (not shown). The feed pump 11 sucks fuel from an inlet 13 and discharges pressurized fuel through a pressure adjustment valve 14 into a pump chamber 15 formed in the pump housing 10. The fuel charged into the pump chamber 15 is used to lubricate parts located within the pump chamber 15 and also is delivered to a piston valve 16. The piston valve 16 includes a cylinder 17 fixed to the pump housing 10 and formed with an inlet port 18 opening into the pump chamber 15, distributing ports 19 communicated with respective delivery valves 21, and a spill port 20. Provided for rotation and reciprocation within the cylinder 16 is a distributing piston 22 having therein a passage for selectively connecting two of the ports 18, 19 and 20. The distributing piston 22 is fixed to a cam disc 23 which in turn is connected through a suitable coupling 24 to the drive shaft 12. The cam disc 23 is formed on its surface with face cams 25 numbered in accordance with the cylinders of the engine. A roller ring 26 is provided which fixedly supports rollers 27 for engagement with the face cams 25 of the cam disc 23. As the drive shaft 12 rotates, the cam disc 23 rotates with its face cams 25 running over the rollers 27, causing rotating and reciprocating movement of the distributing piston 22. As a result, pressurized fuel is fed from the distributing ports 19 to the delivery valves 18 and hence to the fuel injection nozzles (not shown).

The amount of fuel injected through the fuel injection nozzles is determined by the position of a spill ring 28. The spill ring 28 is mounted around a portion of the outer peripheral surface of the distributing piston 22 to cover the spill port 20 when the distributing piston 22 moves to the left in the drawing and open the spill port 20 to release pressurized fuel into the interior of the pump chamber 15 when it moves to the right in the drawing.

The position of the spill ring 28 is adjusted through a link lever 29 by a governor mechanism 30 which is drivingly connected to the drive shaft 12 so that the amount of fuel to the fuel injection nozzles is controlled in accordance with the frequency of rotation of the engine.

The timing of fuel injection which occurs when the face cams 25 run on the rollers 27 is controlled by the angular position of the roller ring 26 with respect to the cam disc 23. For example, if the roller ring 26 is rotated in a direction opposite to the direction of rotation of the cam disc 23, then the face cams 25 ride on the rollers 27 at an earlier time so that fuel injection timing can be advanced with respect to engine crank angle. For this purpose, an injection advance device 31 is provided to adjust the angular position of the roller ring 26 in accordance with the frequency of rotation of the engine.

Referring to FIG. 2, the injection advance device 31 includes a cylinder 32 and a piston 33 reciprocally located in the bore of the cylinder 32 to divide the cylinder bore into two chambers 34 and 35 at the respective ends of the piston 33. The chamber 34 is communicated through a passage 36 with the pump chamber 15. The chamber 35 is connected to the inlet side of the feed pump 11 and held at a low pressure. A spring 37 is provided within the chamber 35 to urge the piston 33 to the right in the drawing. The piston 33 is formed with a recess which receives one end of a drive pin 38 extending through the pump chamber 15 to the roller ring 26.

The fuel pressure in the pump chamber 15 increases in proportion to increase in the frequency of rotation of the feed pump and thus the engine, causing leftward movement of the piston 33 to rotate the roller ring 26 in a direction opposite to the direction of rotation of the cam disc 23 indicated by the arrow so that fuel injection is advanced in accordance with engine speed.

In addition, the injection advance device is associated with manual injection advance means for improving fuel combustion during engine starting. The manual injection advance means includes a cam 39 having a slant face in contact with the piston 33. The cam 39 is rotated through a rotary shaft 40 by a hand-operated lever 41 to force leftward movement of the piston 33 so that fuel can be injected with an advance corresponding to a predetermined crank angle.

In such a conventional injection advance device where injection advance necessary during engine starting is made by manual rotation of the lever 1, however, complex engine starting operations are required which often leads to a failure to operate the manual injection advance means, resulting in unstable engine starting. Furthermore, a large actuator is required to automatically move the piston 33 against a strong force of the spring 37 when the engine is starting.

SUMMARY OF THE INVENTION

It is therefore one object of the present invention to provide an injection advance device which can automatically hold fuel-injection timing advanced before the engine is warmed up.

Another object of the present invention is to provide an injection advance device which can automatically provide an optimum fuel-injection timing according to engine warming conditions.

BRIEF DESCRIPTION OF THE DRAWINGS

The following description of the present invention is had in conjunction with the accompanying drawings, in which like reference characters refer to the same or corresponding parts, and wherein:

FIGS. 4 and 5 are sectional views showing a modified form of the injection advance device, wherein FIG. 5 is a sectional view taken along line V—V of FIG. 4;

DESCRIPTION OF THE PREFERRED EMBODIMENTS

Figure 1:
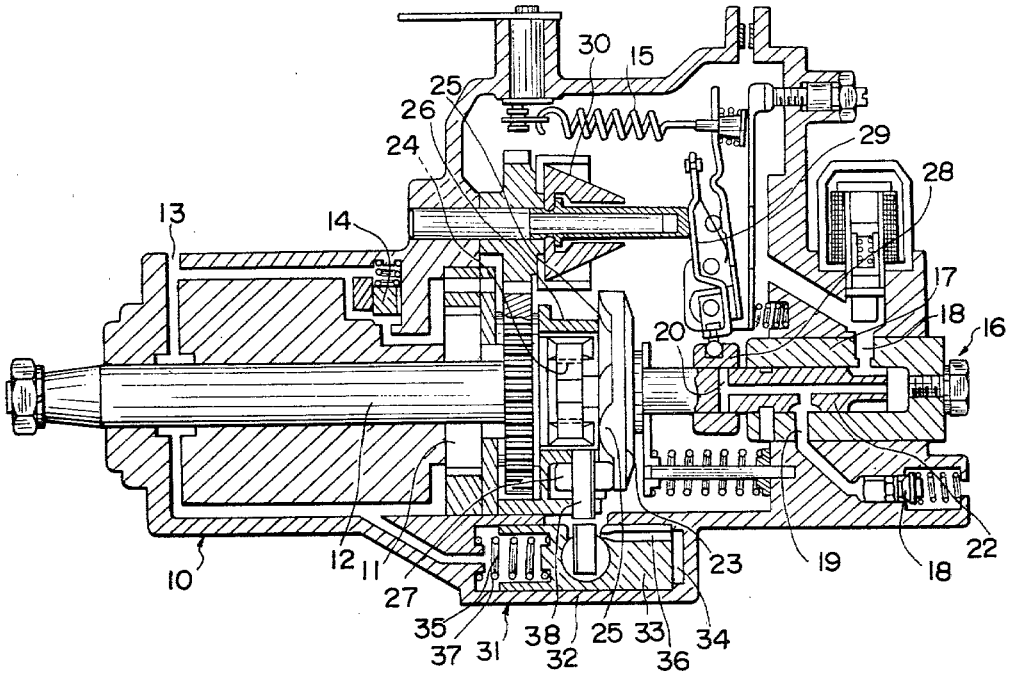
FIGS. 1 and 2 are sectional views showing a convenshown in FIG. 15A. When the engine is started, the cam
Figure 2:
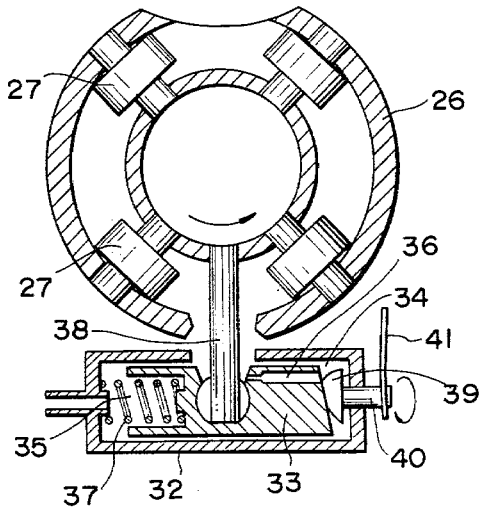
Figure 3:
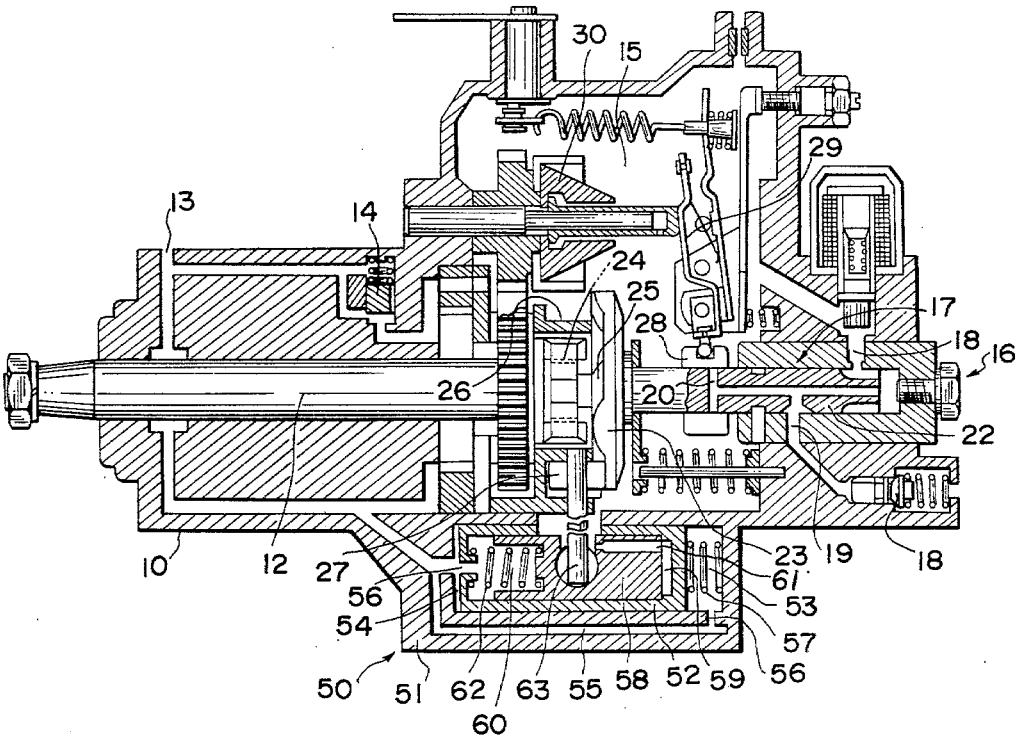
FIG. 3 is a sectional view showing one embodiment of an injection advance device made in accordance with the present invention.

Referring now to FIG. 3, a fuel injection pump, embodying the present invention, is shown with the injections advance device being shown as rotated clockwisely 90 degrees from its actual positions. The structure shown in FIG. 3 is generally the same as shown in FIGS. 1 and 2 except for the injection advance arrangement, and like reference numerals in FIG. 3 indicate like parts as described with reference to FIGS. 1 and 2.

The fuel injection pump includes an automatic injection advance device 50 made in accordance with the present invention. The automatic injection advance device 50 comprises a casing 51 forming integrally with the pump housing 10, and a cylinder 52 reciprocally located in the bore of the casing 51, dividing the casing bore into two chambers 53 and 54 at the respective ends of the cylinder 52. The chamber 54 is connected to the inlet side of the feed pump 11 and the chamber 53 is connected to the inlet side of the feed pump 11 through a release passage 55 having therein an orifice 56. In this embodiment, the release passage 55 is shown as being formed in the casing 51. The cylinder 52 is closed at its one end and formed at the other end thereof with an opening 56. A spring 57 is provided within the chamber 53 to urge the cylinder 52 to the left in the drawing.

A piston 58 is reciptocally located in the bore of the cylinder 52 to divide the cylinder bore into two chambers 59 and 60 at the respective ends of the piston 58. The chamber 59 is communicated through a passage 61 with the pump chamber 15 and the chamber 60 is connected through the opening 56 to the inlet side of the feed pump 11. A spring 62 is provided within the chamber 60 to urge the piston 58 to the right in the drawing. The piston 58 is formed with a recess which receives one end of a drive pin 63 extending through the cylinder 52 and the casing 51 to the roller ring 26.

During normal engine operation, the fuel pressure in the chamber 59 increases with increase in engine rotational frequency, causing leftward movement of the piston 58 against the force of the spring 62 so as to rotate the roller ring 26 in a direction opposite to the direction of rotation of the cam disc 23, whereby fuel injection is advanced in accordance with engine rotational frequency.

When the engine is off, the piston 58 is held at the position, as shown in FIG. 3, by the force of the spring 57 so that fuel can be injected with an advance predetermined suitably for engine starting. Although the cam disc 23 rotates and exerts forces on the roller ring 26 such as to move the cylinder 52 to the right through the drive pin 63 after the engine is started, the orifice 56 provided in the release passage 55 restricts the flow of fuel discharged to the inlet side of the feed pump 11 and increases the fuel pressure in the chamber 53 so as to provide a resistance against the rightward movement of the cylinder 52. As a result, the fuel injection timing is held advanced for a time after the engine is started. The time required for the cylinder 52 to move to its rightmost position is dependent upon the viscosity of the fuel. That is, the lower the engine temperature, the lower is the speed at which the cylinder 52 moves to the right.

Figure 4:
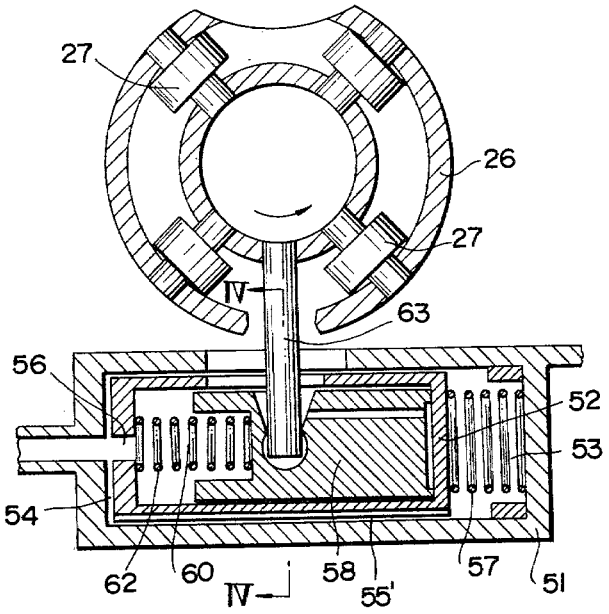
Figure 5:
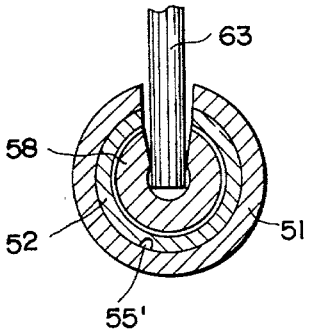

Referring to FIGS. 4 and 5, a modified form of the automatic injection advance device 50 is shown wherein the release passage 55 formed in the casing 51 is eliminated and instead the cylinder 52 is formed in its outer peripheral surface with an axial groove having a predetermined length and cross-sectional area to define a release passage 55' with the inner surface of the casing 51 for communication of the chamber 53 with the chamber 54 and hence with the inlet side of the feed pump 11. The release passage 55' restricts the flow of fuel discharged from the chamber 53 and increases the fuel pressure in the chamber 53 so as to provide a resistance against the rightward movement of the piston 58 after the engine is started. As a result, the fuel injection timing is held advanced for a time after the engine is started.

Figure 6:
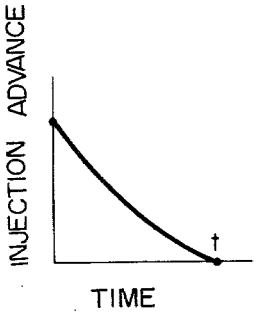
FIG. 6 is a graph showing variations in injection advance provided by the device of the invention.

FIG. 6 shows variations in injection advance with time wherein the character t indicates the time required for the injection advance falls to zero. The time t is dependent upon engine speed, fuel temperature, and other engine conditions and is proportional to a value l/a wherein l is the length of the groove and a is the cross-sectional area of the groove. Accordingly, a desired time t can be selected by the choice of the length and cross-sectional area of the groove. The groove may be formed in spiral form in the outer peripheral surface of the cylinder 52. Thus, the length l of the groove can be freely selected although the cross-sectional area a is selected a limited range from the machining accuracy standpoint. It is to be noted, of course, that the groove may be formed in the inner surface of the casing 51 to define the release passage 55' with the outer periperal surface of the cylinder 52.

Figure 7A:
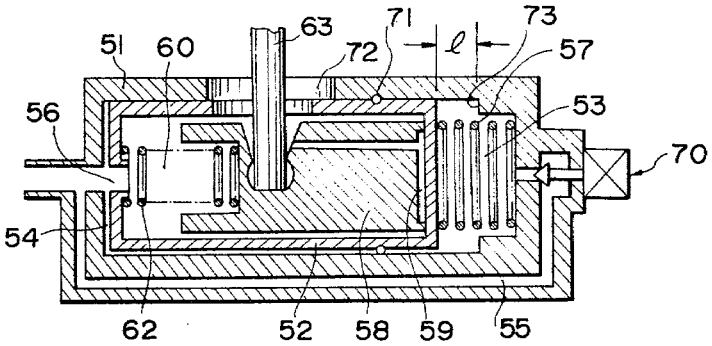
FIGS. 7A and 7B are sectional views showing a second embodiment of the present invention.
Figure 7B:
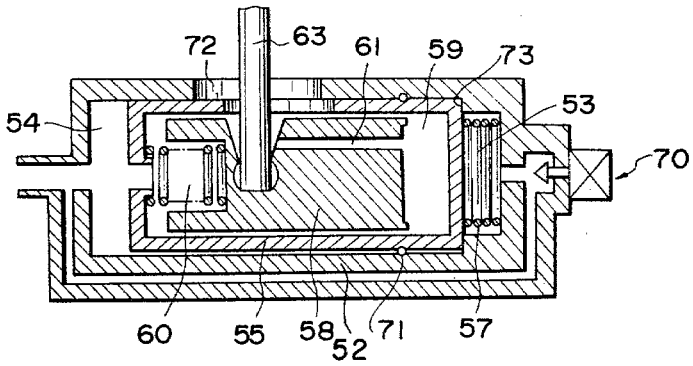

Referring to FIGS. 7A and 7B, there is illustrated a second embodiment of the present invention which is substantially similar to the structure previously described in connection with FIG. 4 except that a solenoid valve 70 is provided in the release passage 55. The solenoid valve 70 is closed to block the flow of fuel from the chamber 53 for a predetermined time after the engine is started. In FIGS. 7A and 7B, the reference numeral 71 designates a seal ring and the numeral 72 an elongated hole formed in the casing 51 for free movement of the drive pin 63.

When the engine is off, the cam disc 23 remains still and exerts no force on the roller ring 26, whereas the fuel pressure in the chamber 59 is equal to that in the chamber 60. Thus, the piston 58 is moved to the right with respect to the cylinder 52 under the force of the spring 62 and the cylinder 52 is moved to the left with respect to the casing 51 under the force of the spring 57 so that the drive pin 63 is held in its neutral position as shown in FIG. 7A. When the engine is started, the cam disc 23 rotates and exerts forces on the roller ring 26 such as to move the piston 58 to the right through the drive pin 63. At this time, however, the solenoid valve 70 remains closed closing the release passage 55 to prevent rightward movement of the cylinder 52 so as to provide an injection advance corresponding to the length l as shown in FIG. 7A which is predetermined for engine starting.

When the engine is warmed up and the solenoid valve 70 opens to provide communication between the chamber 53 and the inlet side of the feed pump 11, the fuel pressure conducted from the pump chamber 15 into the chamber 59 pushes the piston 58 to the left against the force of the spring 60 and the resulting reaction force moves the cylinder 52 rightward against the force of the spring 57 until the cylinder 52 abuts against the shoulder 73 of the casing 51 as shown in FIG. 7B. Thereafter, the fuel pressure in the chamber 59 increases in proportion to increase in engine rotational frequency, causing leftward movement of the piston 58 to rotate the roller ring 26 in a direction opposite to the direction of rotation of the cam disc 23 so that fuel injection is advanced in accordance with engine speed.

Figure 8:
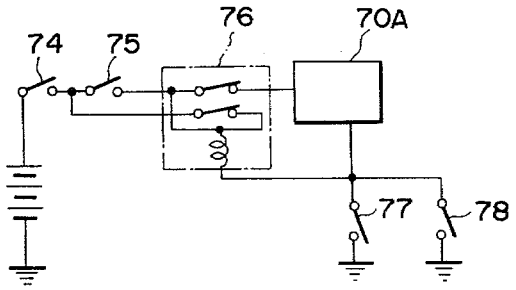
FIG. 8 is a circuit diagram showing a valve drive circuit used in the device of FIGS. 7A and 7B.

Referring to FIG. 8, there is illustrated a circuit for driving the solenoid valve 70. The circuit includes an engine key switch 74, a starter switch 75, a self-hold type relay 76, a pressure responsive switch 77 adapted to become off when the fuel pressure is above a predetermined time; that is, when the engine speed is above a predetermined value, and a temperature responsive switch 78 adapted to become off when the engine coolant temperature is above a predetermined value.

Figure 9A:
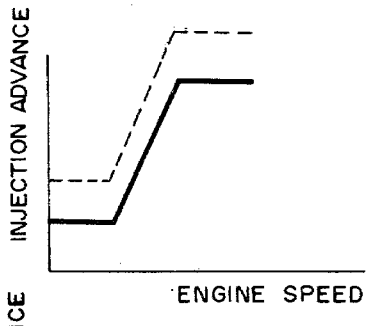
FIG. 9A is a graph showing injection advance characteristics provided by the device of the invention.
Figure 9B:
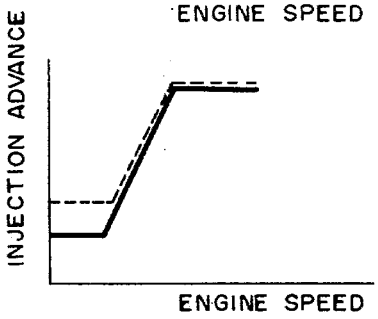
FIG. 9B is a graph showing injection advance characteristics provided by a conventional device.

When the key switch 74 and the starter switch 75 are turned on to start the engine, both of the pressure and temperature responsive switches 77 and 78 are on so that the valve solenoid 74A is energized to close the valve 70. The self-hold type relay 76 holds the temperature responsive switches 77 and 78 are turned off even if the starter switch 75 is turned off. Thus, if the vehicle starts running before the engine is not fully warmed up, the injection advance is always higher than that obtained when the vehicle starts running after the engine is fully warmed up. This is shown in FIG. 9A wherein the broken curve indicates variations in injection advance when the vehicle starts running before the engine is not fully warmed up and the solid curve indicates variations in injection advance when the vehicle starts running after the engine is fully warmed up. With conventional injection advance devices, the injection advance is held higher than that obtained when the vehicle starts running after the engine is fully warmed up only in an initial period after the vehicle starts running as shown in FIG. 9B wherein the broken curve indicates variations in injection advance when the vehicle starts running before the engine is not fully warmed up and the solid curve indicates variations in injection advance when the vehicle starts running after the engine is fully warmed up.

Figure 10:
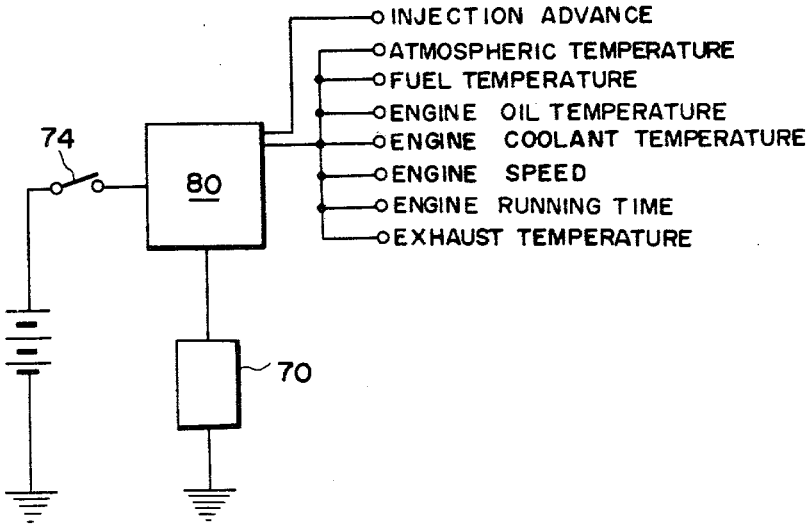
FIG. 10 is a circuit diagram showing another form of the valve drive circuit.

FIG. 10 shows another form of the solenoid valve drive circuit wherein a micro-computer 80 is utilized to provide a pulse signal with its duty cycle varied in accordance with various engine warming conditions such as atmospheric temperature, fuel temperature, engine oil temperature, engine coolant temperature, engine speed, exhaust temperature and engine running time to the valve solenoid so as to alternatively open and close the solenoid valve 70 to thereby allow a gradual reduction in injection advance.

Figure 11:
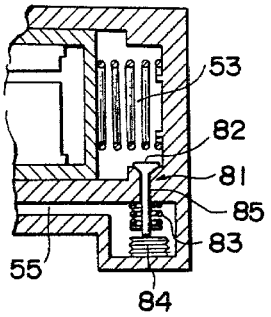
FIGS. 11 and 12 are sectional views showing modifications of the device of FIGS. 7A and 7B.
Figure 12:
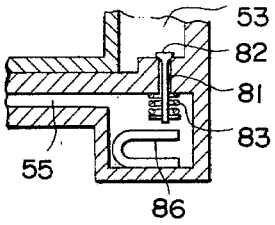

FIG. 11 shows a modified form of the injection advance device wherein the solenoid valve 70 is eliminated and instead a temperature responsive valve 81 is provided in the release passage 55. The temperature responsive valve 81 comprises a poppet valve 82 fitted in an opening 85 through which the chamber 53 is connected to the release passage 55, a return spring 83 urging the poppet valve 82 to its closed position, and a thermostat element 84 placed at a position facing the poppet valve 82. The thermostat element 84 expands at increased fuel temperatures to push the poppet valve 82 against the force of the return spring 83 so as to open the temperature responsive valve 81. The thermostat element 84 may be removed and replaced with a bimetal element 86 as shown in FIG. 12. The bimetal element 86 expands at increased fuel temperatures to push the poppet valve 82 against the force of the return spring 83 so as to open the temperature responsive valve 81.

Figure 13:
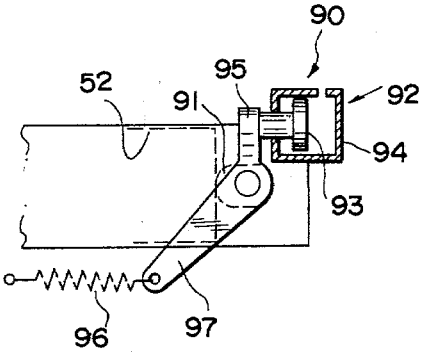
FIGS. 13 and 14 are schematic views showing modifications of the device of FIGS. 7A and 7B.
Figure 14:
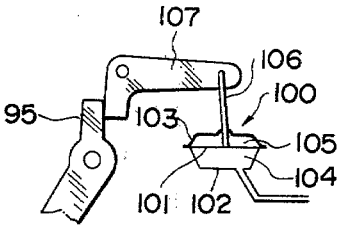

FIG. 13 shows another modification of the injection advance device wherein the cylinder 52 is moved by a mechanism 90 including a cam 91 held in contact with the right-hand end of the cylinder 52, a hydraulic cylinder 92 having a piston 93 reciprocally located within its cylinder chamber 94, a lever 95 drivingly connecting the piston 93 to the cam 91, a spring 96 rotating the cam 91 in a clockwise direction through a lever 97. After the engine is warmed up, pressurized fuel is charged into the cylinder chamber 94 to push the piston 94, causing couter-clockwise rotation of the lever 95 to allow rightward movement of the cylinder 52 so as to reduce the injection advance to zero. When the engine is started, the lever 95 is rotated in the clockwise direction to provide an injection advance by the force of the spring 96. As shown in FIG. 14, the hydraulic cylinder 92 may be removed and replaced with a servo mechanism 100 which includes a diaphragm 101 mounted between the housing 102 and cover 103 to form therewith two chambers 104 and 105 on opposite sides of the diaphragm 101. A drive rod 106 is provided which has its one end fixed centrally on the diaphragm 101 and the other end connected to a L-shaped lever 107 for driving the lever 95. After the engine is warmed up, vacuum is introduced into the chamber 104 to cause counter-clockwise rotation of the lever 95 so as to reduce the injection advance to zero.

Figure 15A:
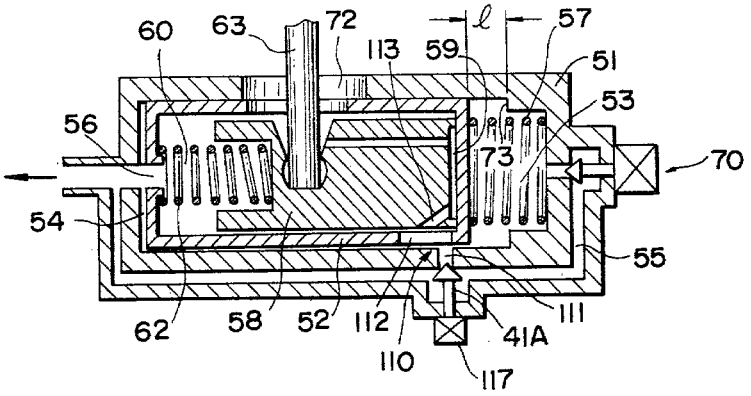
FIGS. 15A and 15B are sectional views showing a third embodiment of the present invention.
Figure 15B:
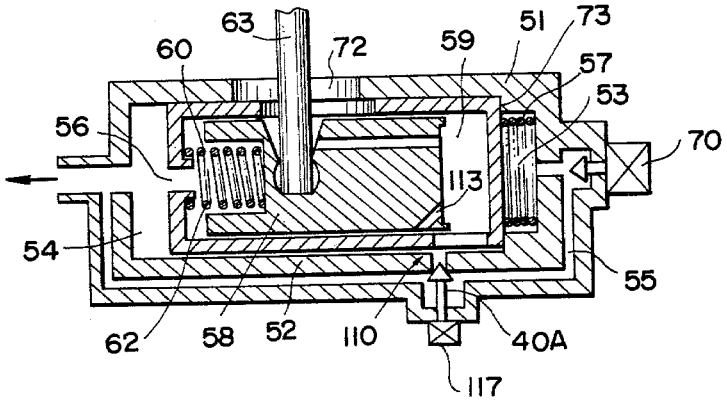

Referring to FIGS. 15A and 15B, there is illustrated a third embodiment of the present invention which is generally similar to the structure previously described in connection with FIGS. 7A and 7B except that a second release passage 110 is formed for communication of the chamber 59 with the first release passage 55 regardless of the position of the cylinder 52. The second release passage 110 includes an opening 111 formed in the casing 51, a slit 112 formed in the cylinder 52, and a slant passage 113 formed in the piston 58 for ensuring communication between the chamber 59 and the slit 112 at the rightmost position of the cylinder 52. The second release passage 110 has therein a second solenoid valve 117 adapted to open, according to need, so as to allow the flow of fuel from the chamber 59 through the second release passage 110 to the first release passage 55 and hence to the inlet side of the feed pump 11.

Figure 16A:
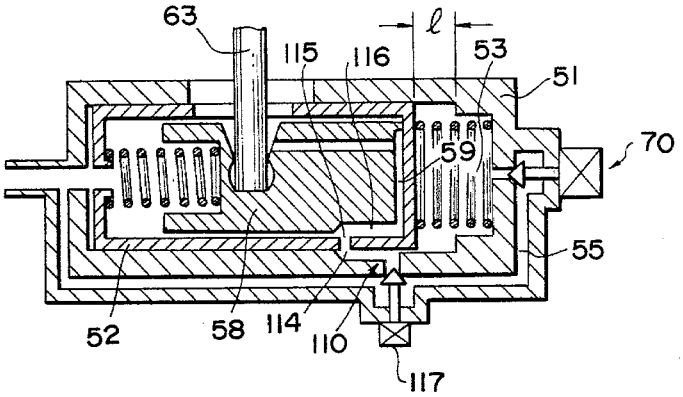
FIGS. 16A and 16B are sectional views showing a modified form of the device of FIGS. 15A and 15B.
Figure 16B:
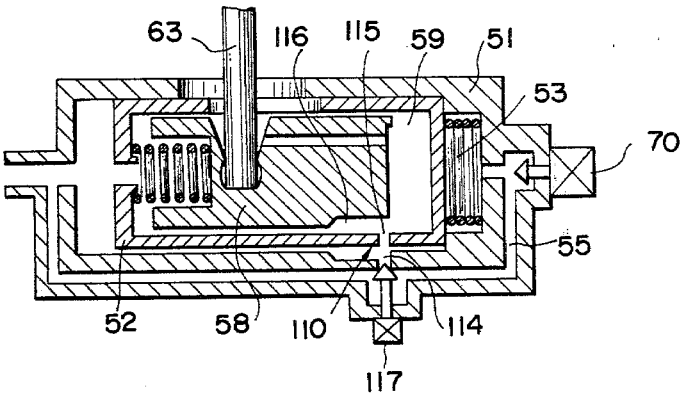

It is to be noted, of course, that the second release passage 110 may be made up of a slit 114 formed in the casing 51, an opening 115 formed in the cylinder 52, and a groove 116 formed in the piston 58 as shown in FIGS. 16A and 16B. In addition, the groove 116 may be formed in the cylinder 52.

Figure 17:
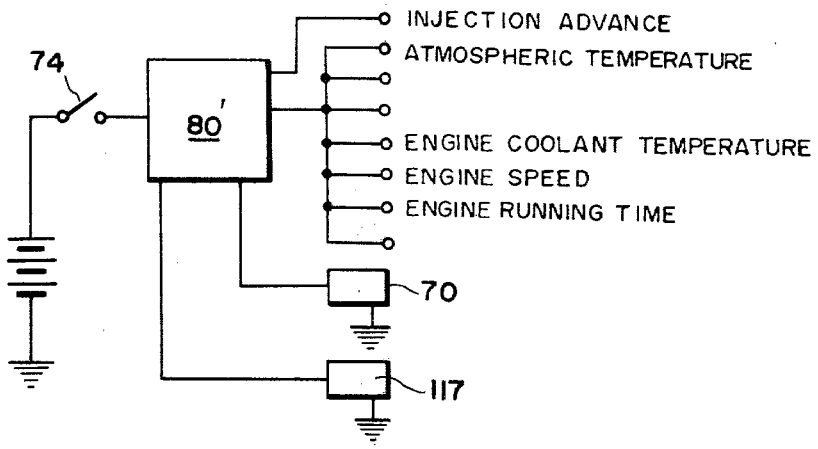
FIG. 17 is a circuit diagram showing a valve drive circuit used in the device of the third embodiment.

FIG. 17 illustrates a circuit 80' for controlling the operation of the first and second solenoid valves 70 and 117 wherein the numeral 74 designates an engine key switch. The valve control circuit 80' receives various signal indicative of atmospheric temperature, engine temperature, engine speed, engine running time, and other engind operating conditions, and also an injection advance indicative signal from an injection advance detector (not shown) adapted to monitor the injection advance from the displacement of the injection nozzle needle valves and the fuel pressure through the injection passages for closing and opening the first and second solenoid valves 70 and 117 so that an optimum injection advance can be obtained in accordance with engine operating conditions.

Figure 18:
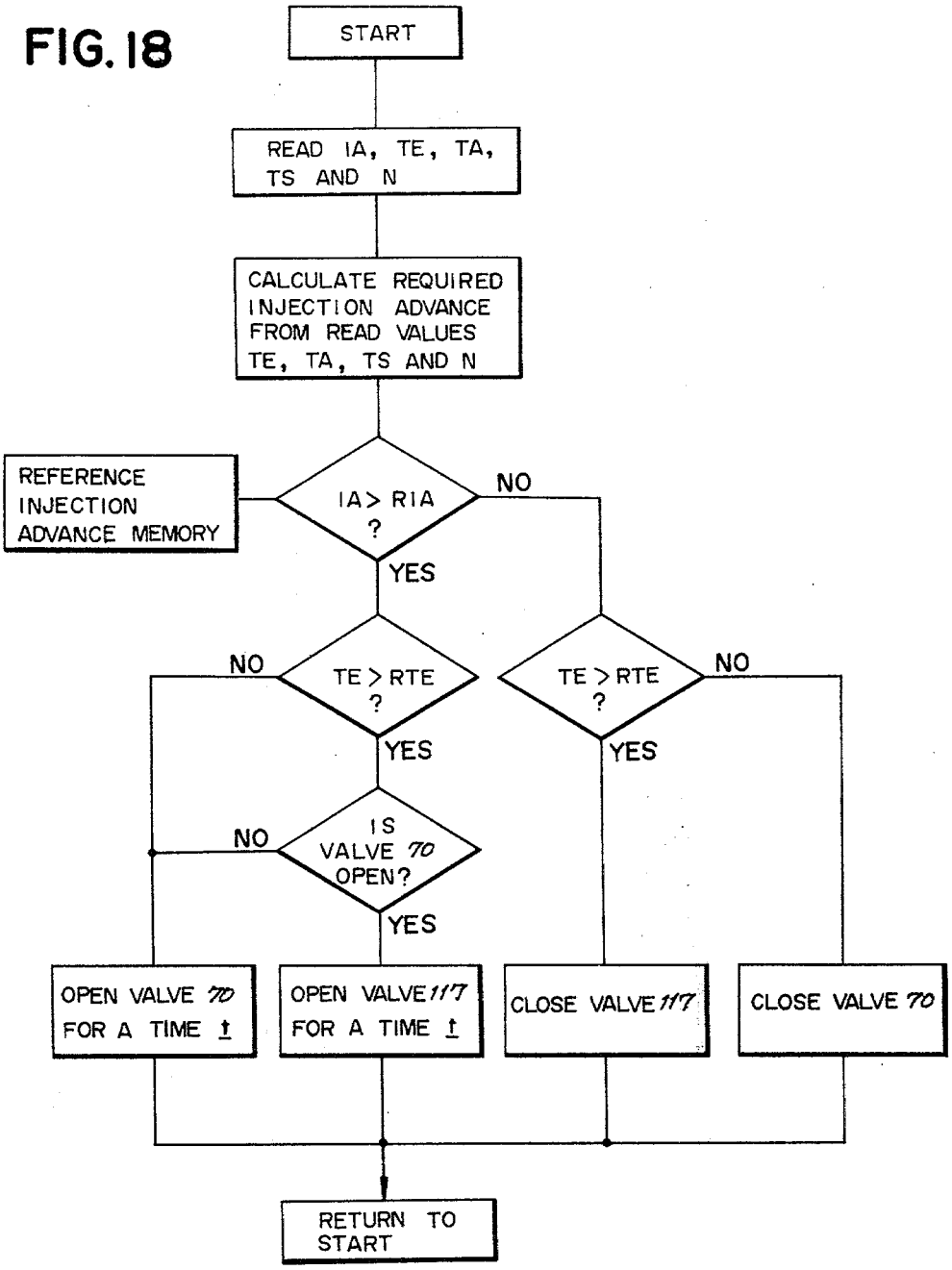
FIG. 18 is a flow chart used to explain the operation of the valve drive circuit of FIG. 17.

FIG. 18 is a flow chart showing the operation of the control circuit 80' of FIG. 17. The control circuit 80' reads engine temperature TE, intake air temperature TA, engine speed N, engine running time TS and fuel-injection advance IA, and calculates the required injection advance from the read values TE, TA, N and TS. Following this, a determination is made as to whether or not the calculated value IA is higher than a reference value RIA stored in a memory. If the calculated value IA is lower than the reference value RIA, the control circuit 80' closes the second solenoid valve 117 under a condition where the engine temperature TE is higher than a reference value RTE, whereas it closes the first solenoid valve 70 until the engine is warmed up under a condition where the engine temperature TE is lower than the reference value RTE.

If the calculated value IA is higher than the reference value RIA, another determination is made as to whether or not the engine temperature TE is higher than a reference value RTE. If the engine temperature TE is lower than the reference value RTE, the control circuit 80' opens the first solenoid valve 70 for a predetermined time t. Otherwise, the control circuit 80' opens the first solenoid valve 70 if it is closed, whereas it opens the second solenoid valve 117 for a predetermined time t so as to retard fuel-injection timing if the first solenoid valve 70 is open. These operations are repeated until the engine is stopped after the engine is started.

When the engine is off, the cam disc 23 remains still and exerts no force on the roller ring 26, whereas the fuel pressure in the chamber 59 is equal to that in the chamber 60. Thus, the piston 58 is moved to the right with respect to the cylinder 52 under the force of the spring 62 and the cylinder 52 is moved to the left with respect to the casing 51 under the force of the spring 57 so that the drive pin 63 is held in its neutral position as shown in FIG. 15A. When the engine is started, the cam disc 23 rotates and exerts forces on the roller ring 26 such as to move the piston 58 to the right through the drive pin 63. At this time, however, the control circuit 80' provides a signal to the first solenoid valve 70 which thereby remains closing the first release passage 55 to prevent rightwrd movement of the cylinder 52 so as to provide an injection advance corresponding to the length l as shown in FIG. 15B which is predetermined for engine starting.

When the engine is warmed to some extent, the control circuit 80' provides a signal to the first solenoid valve 70 which thereby gradually opens the first release passage 55 and eventually opens it fully in accordance with engine warming conditions. As a result, the cylinder 52 moves to the right against the force of the spring 57 until it abuts against the shoulder 73 of the casing 51 as shown in FIG. 15B. Thereafter, the fuel pressure in the chamber 59 increases in proportion to increase in engine rotational frequency, causing leftward movement of the piston 58 to rotate the roller ring 26 in a direction opposite to the direction of rotation of the cam disc 23 so that fuel-injection timing is automatically advanced in accordance with engine speed. The obtained injection advance is read by the control circuit 80' which opens the second solenoid valve 117 to decrease the fuel pressure in the chamber 59, causing rightward movement of the piston 58 so as to retard to the fuel-injection timing to an optimum value in accordance with engine operating conditions if the obtained injection advance is higher than a reference value. Accordingly, it is preferable to design the injection advance device such as to provide an injection advance slightly higher than the optimum value when the second solenoid valve 117 is closed. This may be made by using a weak spring as the spring 62.

Figure 19A:
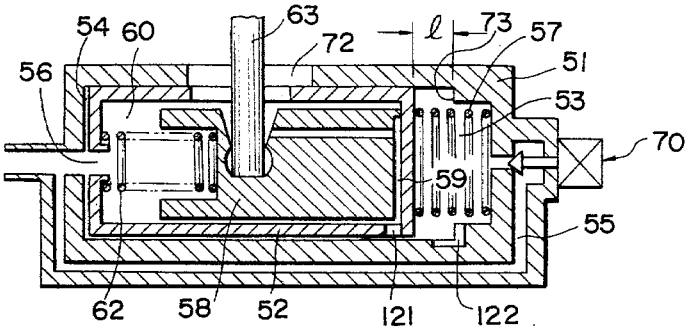
FIGS. 19A and 19B are sectional views showing a fourth embodiment of the present invention.
Figure 19B:
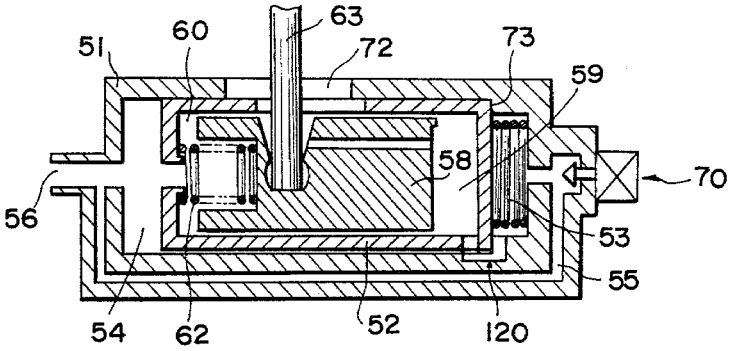

Referring to FIGS. 19A and 19B, there is shown a fourth embodiment of the present invention which is substantially similar to the second embodiment except that a third passage 120 is provided for communication between the chambers 53 and 59 when the cylinder 52 is near its rightmost position. The third passage 120 includes a hole 121 formed in the cylinder 52 and a recess 122 formed in the inner surface of the casing 51.

Figure 20:
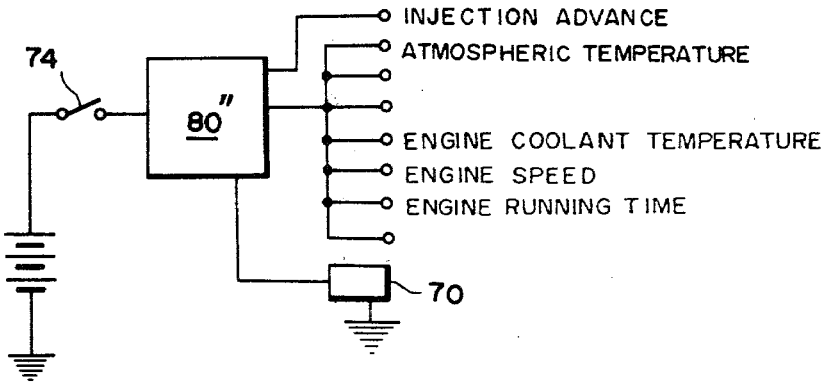
FIG. 20 is a circuit diagram showing a valve drive circuit used in the fourth embodiment.

FIG. 20 shows a circuit 80'' for driving the solenoid valve 70 wherein the reference numeral 74 an engine key switch. The valve drive circuit 80'' receives various signal indicative of atmospheric temperature, engine temperature, engine speed, engine running time, and other engine operating conditions, and also an injection advance indicative signal from an injection advance detector (not shown) adapted to monitor the injection advance from the displacement of the injection nozzle needle valves and the fuel pressure through the injection passages for closing and opening the solenoid valves 70 so that an optimum injection advance can be obtained in accordance with engine operating conditions.

When the engine is off, the cam disc 23 remains still and exerts no force on the roller ring 26, whereas the fuel pressure in the chamber 59 is equal to that in the chamber 60. Thus, the piston 58 is moved to the right with respect to the cylinder 52 under the force of the spring 62 and the cylinder 52 is moved to the left with respect to the casing 51 under the force of the spring 57 so that the drive pin 63 is held in its neutral position as shown in FIG. 19A. When the engine is started, the cam disc 23 rotates and exerts forces on the roller ring 26 such as to move the piston 58 to the right through the drive pin 63. At this time, however, the solenoid valve 70 remains closed closing the first release passage 55 to prevent rightward movement of the cylinder 52 so as to provide an injection advance corresponding to the length l as shown in FIG. 19A which is predetermined for engine starting.

When the engine is warmed to some extent, the solenoid valve 70 gradually opens the first release passage 55 and eventually opens it fully in accordance with engine warming conditions. As a result, the cylinder 52 moves to the right against the force of the spring 57 until it abuts against the shoulder 73 of the casing 51 and at the same time communication is established through the third passage 120 between the chambers 59 and 53.

For example, if the injection advance is lower than an optimum value, the solenoid valve 70 is closed to increase the fuel pressure in the chamber 53 so as to move the cylinder 52 to the left while at the same time to increase the fuel pressure in the chamber 59 so as to move the piston 58 to the left. When the communication between the hole 121 and the recess 122 is broken some time later, the piston 58 moves to the left in a similar manner as described above. If the injection advance is higher than an optimum value, the solenoid valve 70 is opened so as to retard the fuel-injection timing as a manner contrary to the above. Accordingly, it is possible to hold fuel-injection timing at an optimum value in accordance with engine operating conditions.

Figure 21:
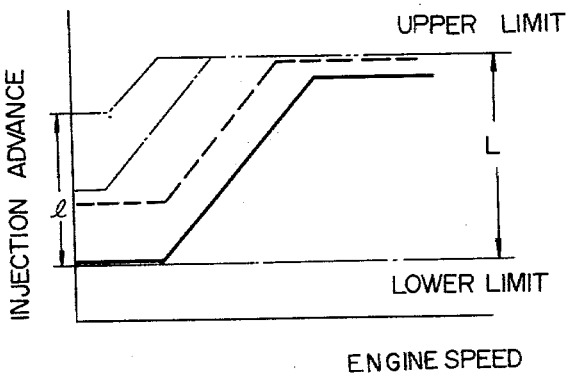
FIG. 21 is a graph showing injection advance characteristics provided by the present invention.

FIG. 21 is a graph showing the range of variations in injection advance obtained by this embodiment wherein the lower limit line indicates zero injection advance and the upper limit line indicates obtained by the injection advance device of FIGS. 19A and 19B. It can be seen from FIG. 21 that an injection advance corresponding to the length l can be obtained during engine starting and the control range is over the full range of movement of the drive pin 63.

Figure 22A:
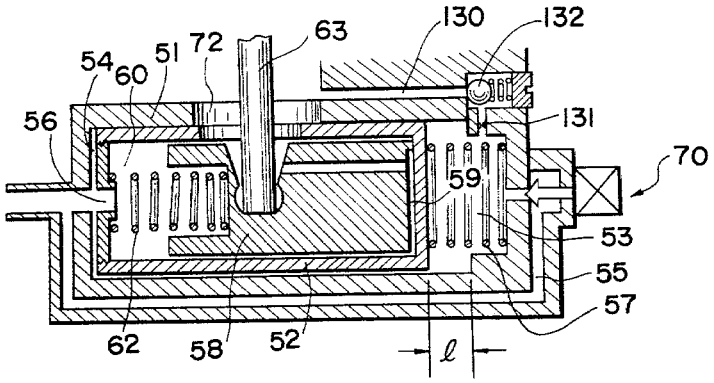
FIGS. 22A and 22B are sectional views showing a fifth embodiment of the present invention.
Figure 22B:
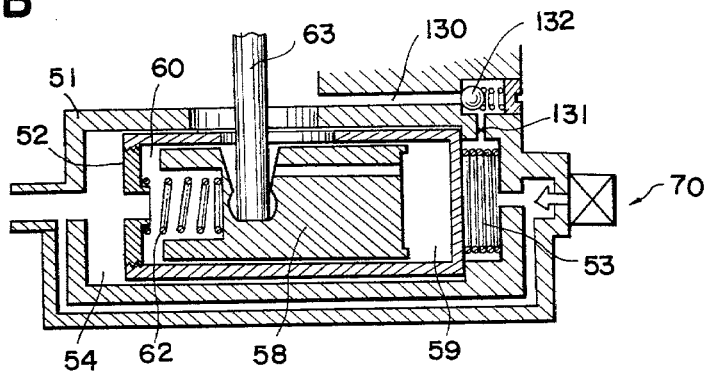

Referring to FIGS. 22A and 22B, there is illustrated a fifth embodiment of the present invention which is substantially similar to the structure of FIGS. 19A and 19B except that the third passage 120 is eliminated and instead a fourth passage 130 is formed in the casing 51 for communication of the pump chamber 15 with the chamber 53. The fourth passage 130 has therein an orifice 131 and a check valve 132 adapted to allow only the flow of fuel to the chamber 53.

When the engine is off, the cam disc 23 remains still and exerts no force on the roller ring 26, whereas the fuel pressure in the chamber 59 is equal to that in the chamber 60. Thus, the piston 58 is moved to the right with respect to the cylinder 52 under the force of the spring 62 and the cylinder 52 is moved to the left with respect to the casing 51 under the force of the spring 57 as shown in FIG. 22A.

When the engine is in operation, the cam disc 23 rotates and exerts forces on the roller ring 26 such as to move the cylinder 52 to the right through the drive pin 63. At this time, however, the fuel pressure increases in the chamber 23 to prevent rightward movement of the piston 58. For example, if the sensed injection advance is lower than a reference value, the control circuit 80'' closes the solenoid valve 70 to increase the fuel pressure in the chamber 53 so as to move the cylinder 58 to the left. Accordingly, it is possible to control the injection advance up to a value corresponding to the length l.

Although the automatic injection advance device is in a state as shown in FIG. 22B at the time when the engine is stopped, the reaction force exerting on the drive pin 63 disappears so that the cylinder 52 is moved leftwards to a position as shown in FIG. 22B.

Figure 23:
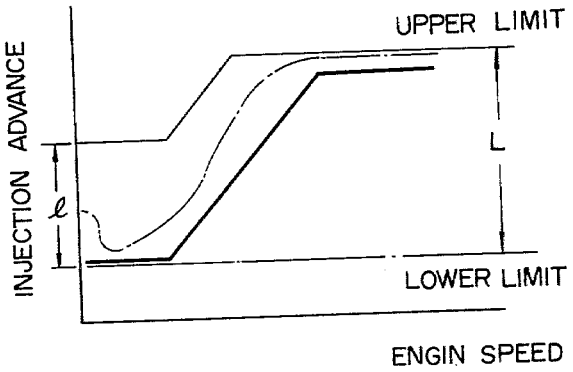
FIG. 23 is a graph showing injection advance characteristics provided by the present invention.

FIG. 23 is a graph showing the range of variation of the injection advance obtained by the automatic injection advance device of this embodiment.

Figure 24:
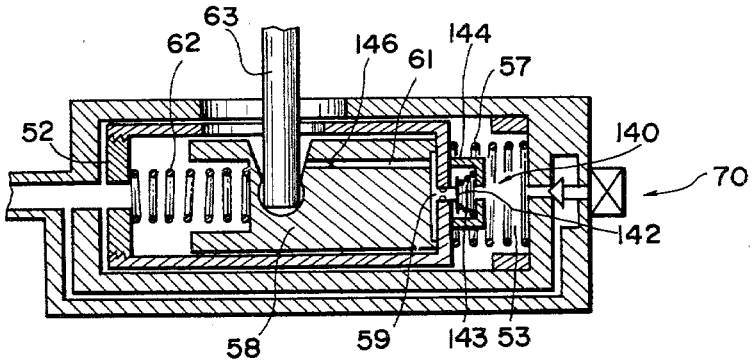
FIG. 24 is a sectional view showing a modified form of the device of FIGS. 22A and 22B.

FIG. 24 shows a modified form of the automatic injection advance device of FIGS. 22A and 22B wherein a check valve 140 is provided in a passage 141 formed in the right-hand end of the cylinder 52 for communication between the chambers 59 and 53. The check valve 140 comprises a valve element 142, a spring 143, and a valve housing 144. An orifice 146 is provided in the passage 141. For example, if the solenoid valve 70 is opened in a state as shown in FIG. 24, the fuel pressure in the chamber 59 rapidly falls since the fuel pressure in the chamber 59 falls at the same time when the fuel pressure in the chamber 53 falls and an orifice 146 is normally provided in the passage 61. This is effective to move the cylinder 52 with a higher response to the operation of the solenoid valve 70.

It is to be understood that the scope of the invention is not to be restricted to the embodiments above described but rather, in view of the numerous modifications and changes which will readily occur to those skilled in the art, the scope of the invention is set forth in the appended claims.

What is claimed is:

1. In a fuel injection pump for use in a diesel engine, said fuel injection pump including a pump housing defining an interior pump chamber, said housing containing a feed pump for supplying fuel under pressure substantially proportionally to engine speed to said pump chamber, and a fuel-injection timing control member movable to determine a fuel-injection timing corresponding to its position, an injection advance device comprising:

(a) a casing fixed to said pump housing;

(b) a cylinder slidably located in said casing to form first and second chambers at the respective ends of said cylinder, said first chamber being in communication with said feed pump inlet side and said second chamber being in communication through a release passage with said feed inlet side;

(c) first spring means located in said second chamber for urging said cylinder toward said first chamber so as to advance the fuel-injection timing;

(d) a piston slidably located in said cylinder to form third and fourth chambers at the respective ends of said piston, said third chamber communicating with said feed pump inlet side, said fourth chamber communicating with said pump chamber, said piston being drivingly connected to said control member;

(e) second spring means located in said third chamber for urging said piston towards said fourth chamber; and (f) valve means provided in said release passage for interrupting communication between said second chamber and said feed pump inlet side so as to prevent said cylinder from moving towards said second chamber in response to at least one engine operating parameter.

2. An injection advance device according to claim 1, wherein said release passage is defined by a groove formed in the outer surface of said cylinder.

3. An injection advance device according to claim 1, wherein said valve means comprises an orifice provided in said release passage.

4. An injection advance device according to claim 1, wherein said valve means comprises a temperature responsive valve adapted to open said release passage above a predetermined temperature.

5. An injection advance device according to claim 4, wherein said temperature responsive valve comprises a poppet valve provided in said release passage, a return spring urging said poppet valve to its closed position, and a thermostat element adapted to expand so as to push said poppet valve to its open position against the force of said return spring in responsive to an increase in temperature.

6. An injection advance device according to claim 4, wherein said temperature responsive valve comprises a poppet valve provided in said release passage, a return spring urging said poppet valve to its closed position, and a bimetal element adapted to expand so as to push said poppet valve to its open position against the force of said return spring in response to an increase in temperature.

7. An injection advance device according to claim 1, wherein said valve means comprises a solenoid valve, and which further comprises valve control means for controlling the opening of said solenoid valve in accordance with various engine warming condition indicative factors and the injection advance with which fuel is injected to said engine.

8. An injection advance device according to claim 7, which further comprises a third release passage connecting said pump chamber to said second chamber when the fuel pressure in said pump chamber is above a predetermined value.

9. An injection advance device according to claim 8, wherein said third release passage is made up of a port formed in said cylinder and connected to said fourth chamber and a recess formed in the inner surface of said casing for connection to said port when said cylinder is near the end of said casing facing said second chamber.

10. An injection advance device according to claim 8, wherein said third release passage is formed in said casing and provided therein a check valve for allowing only the flow of fuel toward said second chamber.

11. An injection advance device according to claim 8, wherein said third release passage is formed in the end wall of said cylinder facing said second chamber and provided therein a check valve for allowing only the flow of fuel toward said second chamber.

12. An injection advance device according to claim 7, which further comprises a second release passage connecting said fourth chamber to said first release passage, a second solenoid valve provided in said second release passage, and valve control means for controlling the opening of said first and second solenoid in accordance with various engine warming condition indicative factors.

13. An injection advance device according to claim 12, wherein said second release passage is made up of a first port formed in said casing and connected to said first release passage and a second port formed in said cylinder connected to said fourth chamber, and said first and second ports positioned for communication of said fourth chamber with said first release passage when said piston is near the end of said cylinder facing said second chamber.

* * * * *